United States Patent [19]

Hargett, Sr.

[11] Patent Number: 4,917,037

[45] Date of Patent: Apr. 17, 1990

[54] COMPOSITE FIBERGLASS AND METAL BOAT

[76] Inventor: Dan Hargett, Sr., P.O. Box 51282, Lafayette, La. 70505

[21] Appl. No.: 252,110

[22] Filed: Oct. 3, 1988

Related U.S. Application Data

[63] Continuation-in-part of Ser. No. 156,445, Feb. 16, 1988, Pat. No. 4,821,667.

[51] Int. Cl.[4] ..... B63B 3/09

[52] U.S. Cl. ..... 114/357; 114/356; 114/355

[58] Field of Search ..... 114/355, 356, 357, 352, 114/85, 219, 65 R, 68

[56] References Cited

U.S. PATENT DOCUMENTS 3,085,262 4/1963 Plemmons ..... 114/352

3,871,043 3/1975 Davidson et al. ..... 114/356

*Primary Examiner*—Sherman D. Basinger

*Assistant Examiner*—Edwin L. Swinehart

*Attorney, Agent, or Firm*—Pravel, Gambrell, Hewitt, Kimball & Krieger

[57] ABSTRACT

The present invention relates to a novel type of boat construction wherein a metal hull, comprised primarily of aluminum metal and there is fitted thereupon a fiberglass interior supported along the exterior outer edge of the hull, with the interior defining a space for occupants of the boat, and spaced apart from the hull itself at points all except the exterior continuous edge of contact between the hull and the interior fiberglass lining.

7 Claims, 4 Drawing Sheets

COMPOSITE FIBERGLASS AND METAL BOAT

This is a continuation-in-part of application bearing U.S. Ser. No. 156,445, filed Feb. 16, 1988, U.S. Pat. No. 4,821,667, Apr. 18, 1989.

BACKGROUND OF THE INVENTION

1. Field of the Invention

The present invention relates to boats. More particularly, the present invention relates to a composite boat structure including an upper fiberglass shell fixed to a metal hull for defining the interior of the boat.

2. General Background

On the subject of boat construction, most small boats, the type for accommodating boaters or fishermen, known as "Bass" boats, are the type which utilize structure which comprises a hull portion and an interior portion. In most cases, both the hull and interior are constructed of either fiberglass, metal, or for older boats, wood. For such boats, there is in the present state of the art the requirement that the space intermediate the hull and the interior portion of the boat be filled with foam so as to prevent sinkage of the boat should the boat encounter an obstacle and split open during operation.

In addition, there are present in the art, boats which may have a metal hull, and hull accommodating an interior fiberglass lining, of the type disclosed in U.S. Pat. No. 3,871,043, wherein the hull and the liner are formed so that the liner substantially fits the configuration of the hull, and the liner and the hull serve as a composite hull structure.

In addition there is hull construction for boats wherein a rigid inner boxlike structure of steel or aluminum is provided and serves as the main structural element of the hull and is bound to a rigid synthetic foam core which binds to the exterior surface. Also there is provided a layer of fiberglass over the foam for providing a protective outer skin for the hull. This structure is disclosed in the U.S. Pat. No. 4,365,580.

Other patents such as U.S. Pat. No. 3,220,027, entitled "Boat Hull Construction"; U.S. Pat. No. 2,384,966 entitled "Composite Boat Construction"; U.S. Pat. No. 3,559,221 entitled "Hull For A Small Boat"; and U.S. Pat. No. 2,312,722 entitled "Metal Boat", all relate to boat construction of smaller types boats and may be pertinent to the present invention.

There is presently pending U.S. Patent Application Ser. No. 156,445, filed Feb. 16, 1988, which relates to a novel type of boat construction wherein a metal hull, comprised primarily of aluminum metal is fitted upon a fiberglass interior and supported on the hull along the exterior outer edge of the hull, with a fiberglass interior defining a space where occupants of the boat, and spaced apart from the hull at all points except where the exterior continuous edge of contact between the hull and the interior fiberglass lining.

SUMMARY OF THE PRESENT INVENTION

The present invention relates to an improved boat construction over Applicant's invention claimed in U.S. Application Ser. No. 156,445, by disclosing a boat having a metal hull, primarily of aluminum metal, where there is a fiberglass interior, the cap attached to the hull along an interior upper rim of the hull, so that the fiberglass cap would be spaced apart from the hull itself, and the interior attachment would provide a means for preventing contact between objects that may come in contact with the hull, but not contact the edge of the fiberglass cap which may damage the cap.

Therefore, it is an object of the present invention to provide a composite boat structure including an aluminum hull and fiberglass interior attached thereto;

It is a further object of the present invention to provide a composite bass boat structure so that an interior fiberglass portion of the boat is positioned and attached along a common edge joint which is interior to the outermost exterior edge of the metal hull;

It is still a further object of the present invention to provide a composite bass boat structure with a metal reinforced hull affording a composite fiberglass interior so that placement of the interior onto the hull allows the interior to make contact substantially along a common exterior edge; and It is still a further object of the present invention to provide a composite bass boat having a reinforced metal hull with the ability of the hull to accommodate various configurations of fiberglass interior portions set upon and attached thereto.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
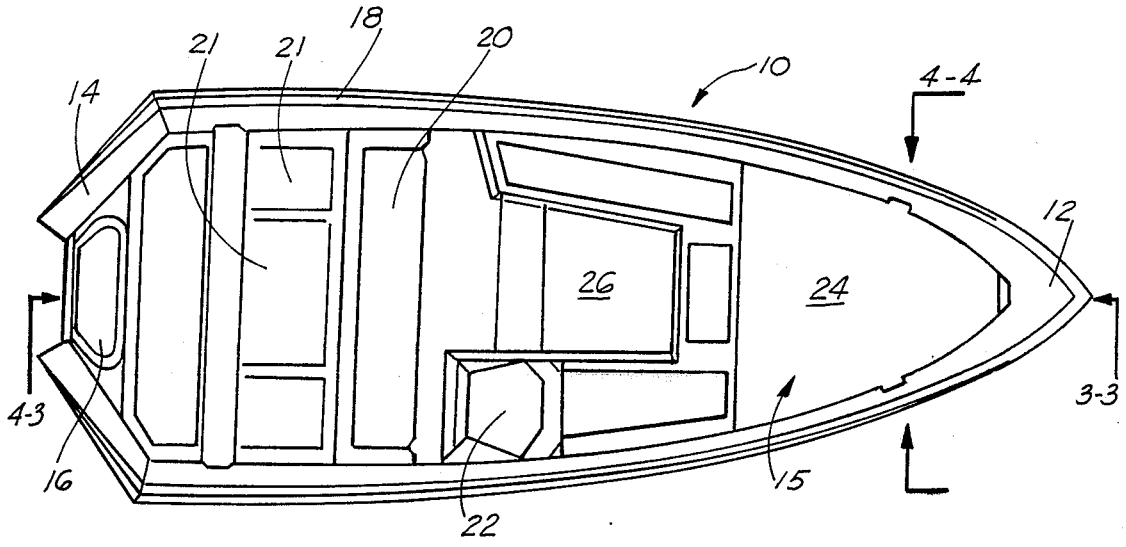
FIG. 1 is a top view of a common bass boat configuration incorporating the present invention.

FIGS. 1 through 5 illustrate the preferred embodiment of the present invention by the numeral 10. For purposes of the present invention boat 10 is illustrated as comprising a typical "Bass" boat of the type utilized to have several fishermen in an open interior, for undertaking outdoor sports fishing. As illustrated in FIG. 1, bass boat 10 would be configured having a front portion 12 and a rear portion 14, the front portion 12 aerodynamically configured for ease of movement through the water, and rear portion 14 including a transom portion 16 for accommodating a typical outboard motor for the type for propelling the boat in the water. As illustrated, boat 10 would comprise a top portion 15, referred to as the boat interior, which includes an outer exterior mounting rim 18, a seat 20, a console 22 for housing the steering wheel and the boat controls, for the operation of the boat. The boat would also include an upper deck 24 and a interior deck 26 for allowing movement around the boat for fishing and the like during use. There is also included a plurality of bait boxes 21 directly to the rear of seat 20 in the preferred embodiment of the boat. For purposes of FIG. 1, as recited earlier, this is a typical bass boat structure which is utilized presently in the art.

Figure 2:
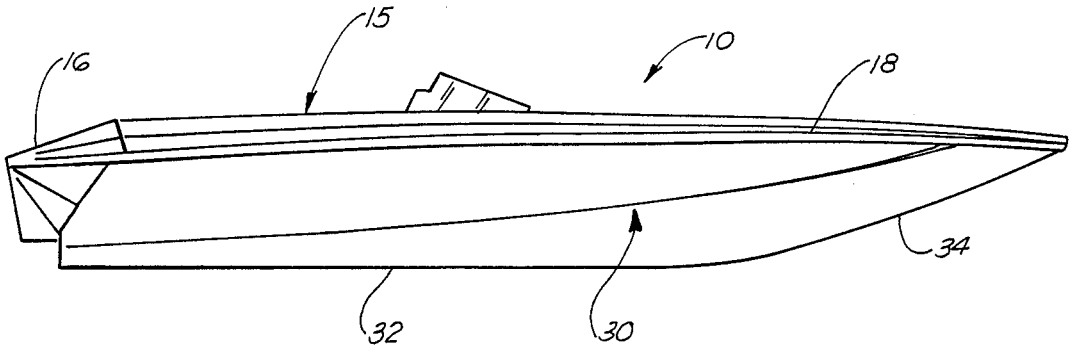
FIG. 2 is a side view of a common bass boat configuration incorporating the present invention.
Figure 3:
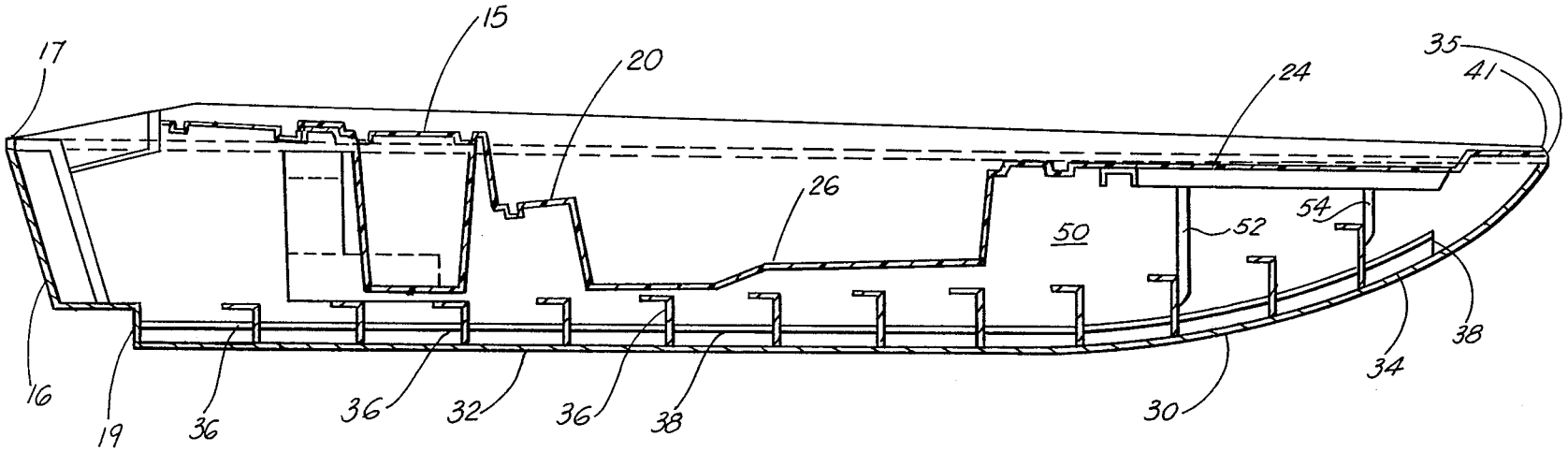
FIG. 3 is a cross-sectional view along lines 3—3 in FIG. 1 which embodies the present invention.

In FIG. 2 there is illustrated a side view of bass boat 10 illustrating an exterior hull portion 30, having a substantially horizontal underside 32 with a sloping forward rate portion 34 for again cutting through the water as the boat is propelled therethrough. Again there is included in side view transom 16 for mounting a motor thereupon, and the exterior upper edge portion 18 along its perimeter. As illustrated in the Figures, the hull portion 30 would be comprised principally of a lightweight metal such as aluminum or steel, of sufficient thickness to overcome any possible obstacles within the water, and the interior portion 15, which configures the top portion of the boat as seen in FIG. 1 constructed of a fiberglass material so that the boat is constructed of, as seen in FIG. 3, a fiberglass interior 15 attached to the metal hull 30 along mounting rim 18. Therefore, this composite boat structure, as will be discussed further, incorporates a hull of strength and structural integrity, yet accommodates an interior portion set upon the hull and attached thereto which is lightweight, and can be molded to configure the required portions as illustrated in top view in FIG. 1.

Turning now to FIG. 3, hull 30 as seen in crosssectional view comprises a composite metal frame 32 extending from the rear transom portion 16 at upper edge 17 to the upward sloping rake portion 34 at upper edge 35 on the front end portion. There is further provided a plurality of interior metal support I beams 36 extending across the width of the hull in transverse configuration, each I beam 36 substantially equally spaced and extending up the rake portion 34 a substantial distance. In addition, there is illustrated a longitudinally positioned beam 38 extending the length of the hull 30 from the rear end portion 19 forward intersecting the plurality of support I beams 36 again up the rake 34 to a distance substantially adjacent the forward end portion of the boat. The combination of the transverse support I beams 36 and the longitudinally positioned beam 38 provide a metal hull having structural integrity to enable the boat to easily move as it is propelled through the water.

Further illustrated in FIG. 3 is the interior lining 15. As seen in the Figures, interior lining 15 includes a forward attachment point 41 which in cross-sectional view attaches at the hull along the common edge 35 and extends rearwardly to configure the shape of the upper deck 24, the lower deck 26, the seat portions 20 and the other components of the interior of the boat for housing the occupants therein. For purposes of structure it should be made clear that the fiberglass interior 15 is supported primarily onto the hull 30 along the common mounting rim 18 so that substantially the interior 15 is positioned a distance apart from the hull 30 and defines an interior space 50 between the hull 30 and the interior lining 15. In addition, for further support there is included a pair of mounting members 52 and 54 which extend interiorly between the hull 30 and the interior 15 for insuring structural integrity between the hull and the upper deck portion 24. In addition at lower deck 26 there is support between the transverse beam 36 and the lower portion of the interior 15 which defines the lower deck for the same purposes of structural integrity. However, for all purposes, interior 15 is substantially mounted on the hull along its exterior perimeter 18.

Figure 4:
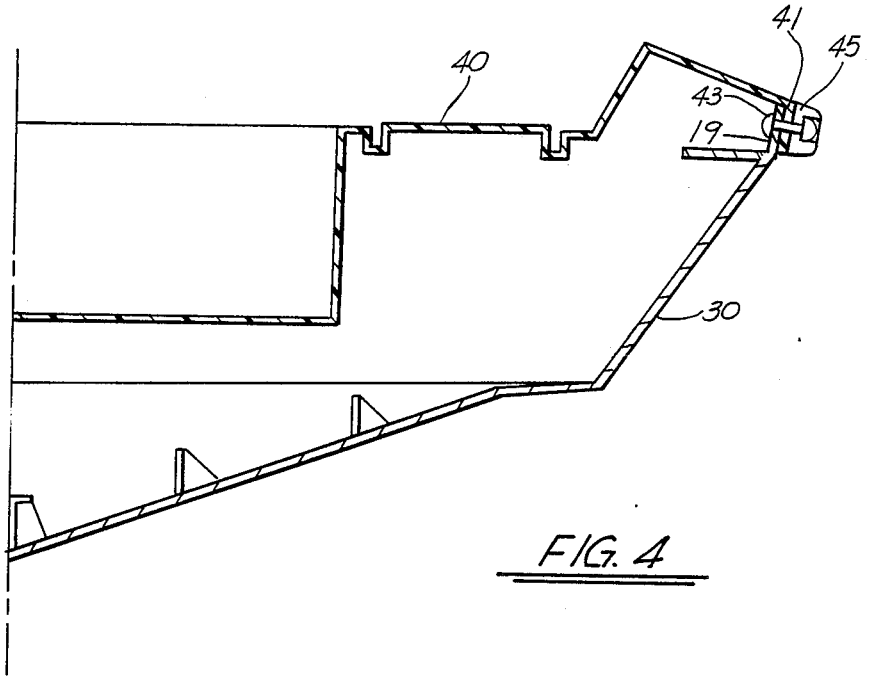
FIG. 4 is a partial cross-sectional view along lines 5—5 in FIG. 1 illustrating attachment between the lower hull and the upper interior portion of the boat.
Figure 5:
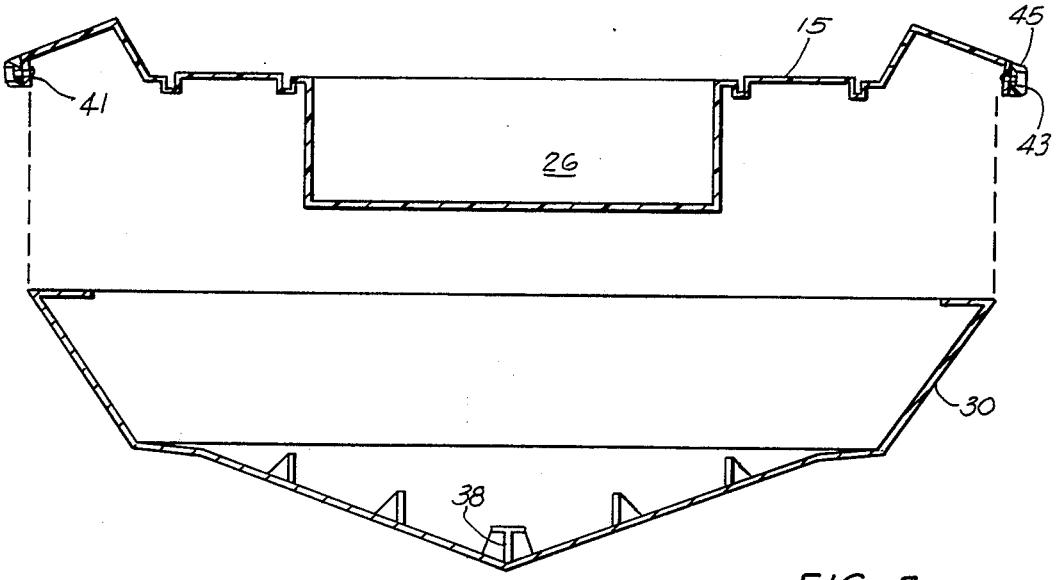
FIG. 5 is a cross-sectional exploded view of the composite metal hull/fiberglass interior composite boat.

FIG. 4 illustrates the mounting means between the hull 30 and the interior lining 15 of the boat 10. As seen in Figure, interior lining 15 includes a downward depending shoulder edge 41 which would substantially overlap around the continuous outer edge 19 of hull 30, and once in position would form a composite joint between hull 30 and boat interior 15. Following the positioning of boat interior 15 onto hull 30, there is provided a plurality of bolt members 43 which are secured to engage the hull 30 with the interior lining of the boat 15 spaced along the edge 18 around the perimeter of the boat, so that the hull is secured to the boat interior. Following the positioning of the bolts 43 to secure the interior 15 onto the hull 30, a continuous exterior flexible material 45 is positioned around the exterior joint so as to shield the mounting bolts 43 and to serve as a protective barrier between the edge of the boat and the obstacles that the boat may encounter during operation. FIG. 5 illustrates in exploded view a cross-sectional view of the hull 30 in relation to the interior 15, so that, as seen in phantom view, the interior 15 again is mounted to the hull only along the exterior perimeter rim 18 and is maintained a distance apart from the hull.

It is through this novel configuration of the metal hull adapted to receive and support a boat interior along a common exterior edge that provides the necessary combination for allowing the boat to be easily maneuverable, lightweight, yet have the structural integrity of a boat in order to be propelled at high speeds thru the water. In addition, it is foreseen that due to the manner in which the fiberglass interior 15 can be molded, the boat may accommodate various configurations of interiors so that the owner of the boat may simply have interior removed and a second or third type of interior set down in its place and in effect receive an entirely "new" boat.

FIGS. 6–9 represent the new and improved embodiment of the present invention. As seen in the FIGURES, there is illustrated bass boat 100 which, is a type of bass boat that is illustrated in FIG. 1, and has been described previously.

As seen in FIG. 5, Applicant's original design incorporated a top portion 15 which included an exterior mounting rim 18, the mounting rim 18 as seen in FIGS. 4 and 5, connecting onto the lower hull portion 30 by means of a common edge 35 and extending rearwardly to configure the shape of the upper deck 24, the lower deck 26 and other components of the boat. For purposes of structure the fiberglass interior 15 was supported primarily onto the hull 30 along the common mounting rim 18, which resulted in the outer edge of the fiberglass cap 15, as seen in FIG. 4, extending to a point from the furthermost edge of the exterior of the boat, and thereby being susceptible to possible contact with foreign objects such as stumps, stock pilings or the like, which could not necessarily do damage to the lower metal hull 30, but may do serious damage to the fiberglass cap which was exposed as seen in FIG. 4.

Figure 6:
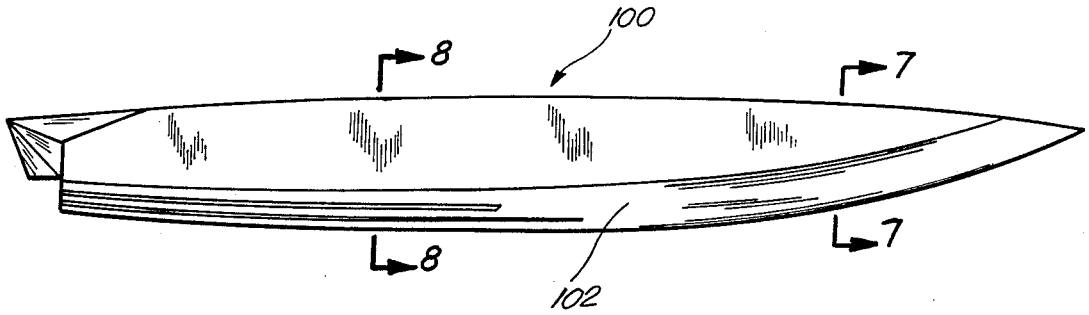
FIG. 6 is a side view of a common bass boat configuration incorporating the present invention.
Figure 7:
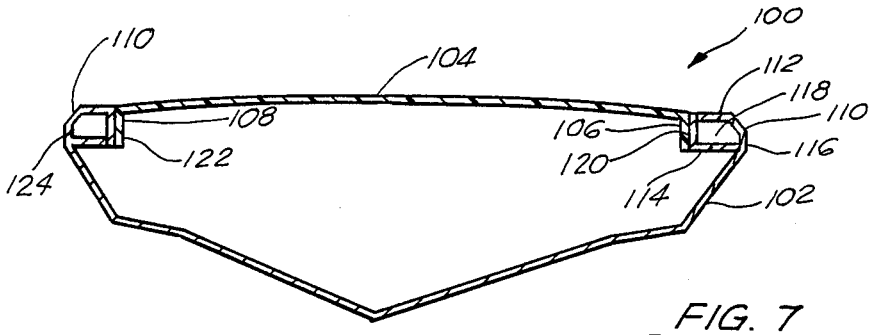
FIG. 7 is a view along lines 7—7 in FIG. 6 which embodies the present invention.

Therefore, in this new embodiment, there is illustrated composite boat 100 again, as seen in FIG. 7, which is a cross-section view of the composite boat along lines 7—7 in FIG. 6, wherein there is again illustrated the lower metallic hull 102, with the fiberglass cap 104 positioned and engagement therewith along edge 106 and 108. However, as seen in the figures particularly in FIG. 6, lower hull 102 includes an inner depending top edge 110 performing an interior fold 114 that returns to point 116 to form a rounded border portion 118 along the entire exterior hull. There is therefore defined an interior vertical edge 120 which serves as an attachment point upon which upper cap 104 would be attached to metal hull 102. Likewise, cap 104 also includes a vertical downward depending lip 122 which would matingly engage along the edge 120 of hull 102, so that cap 104 and hull 102 may be attached between edge 120 and lip 122, and therefore result in the composite boat 100 as seen in FIG. 7, yet with cap 104, although securely attached to hull 102 would be a bolting or the like attachment is provided with an hull rim 112 completely around the outer perimeter of the boat so that any contact with the exterior 124 of hull 102 would not result in contact with cap 104.

Figure 8:
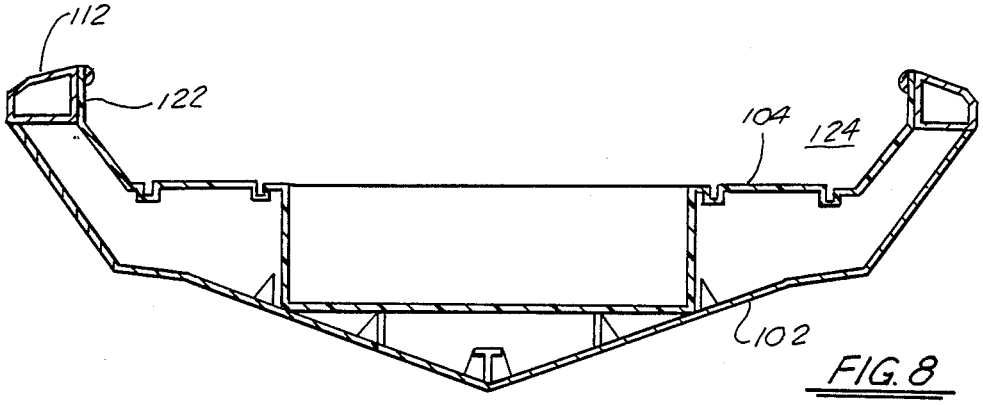
FIG. 8 is a cross-section view along lines 8—8 in FIG. 6 illustrating attachment between the hull and the upper fiberglass portion of the boat.
Figure 9:
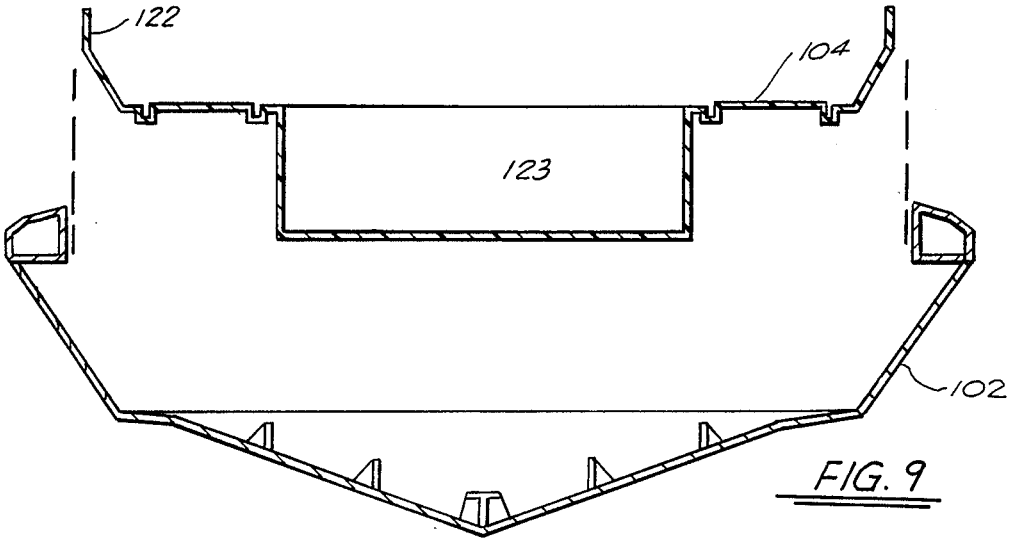
FIG. 9 is a cross-section exploded view of the composite hull/fiberglass interior as illustrated in FIG. 8.

In FIGS. 8 and 9 there is illustrated additional cross-section view of cap 104 being positioned within hull 102. The configuration of cap 104 at this particular point in the boat as seen in FIG. 6 is along the passenger section, so that there is defined a well 122 and a lower portion 124 of the boat wherein passengers would be maintained therein. However, again for purposes of attachment between hull 102 and cap 104 it is foreseen in FIGS. 8 and 9 that the attachment is such that the fiberglass cap 104 is attached to hull 102 as was illustrated in FIG. 7, in such a manner that there is defined again the exterior hull rim 112 around the perimeter of the boat, with the attachment lip 122 of cap 104 securely attached interiorly of the hull, and therefore not susceptible to damages by being struck by outside objects.

For purposes of construction, all other manner of construction as was related in FIGS. 1–5 of the application as previously filed, and similar to the present construction. The present construction would solve the problem of damage which the fiberglass cap may incur under the previous instruction as disclosed in Applicant's pending application.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A boat comprising:

(a) a lower metallic hull portion, defining an upper common edge around the perimeter of a wall portion, the common edge defining an attachment point interiorly of the common edge of the hull;

(b) a molded fiberglass upper portion, configured to be positioned onto the metal hull, and including an exterior downward depending lip, for matingly engaging an inner depending edge of the hull, so that the upper fiberglass portion is positioned interiorly of the common edge of the metal hull, for preventing contact between the fiberglass upper portion and outside obstacles.

2. The boat in claim 1 further including attachment means for securing the molded fiberglass upper portion and the metallic hull along the common edge, so that the interior of the boat is maintained as an upper portion and in spaced apart relation from the hull, to form the composite boat structure.

3. A composite fiberglass and metal boat, comprising:

(a) a lower metallic hull portion, defining an upper common edge around the perimeter of a wall portion, the common edge defining an attachment point interiorly of the common edge of the hull;

(b) a molded fiberglass upper portion, configured to be positioned onto the metal hull, and including an exterior downward depending member, for matingly engaging an inner depending edge of the hull, so that the upper fiberglass portion is positioned interiorly of the common edge of the metal hull, for preventing contact between the fiberglass upper portion and outside obstacles; and (c) means for securing the molded fiberglass upper portion and the metal hull along the common edge, so that the interior of the boat is maintained as an upper portion and in spaced relation from the hull, to form the composite boat structure.

4. The boat in claim 3, wherein the metal hull portion is further constructed of aluminum or other lightweight metal.

5. The boat in claim 3, wherein the fiberglass interior portion further comprises a molded fiberglass interior positionable on the hull along the common edge.

6. The boat in claim 3, wherein the attachment means for securing the interior of the boat to the hull further comprises a plurality of bolt members spaced along the common edge for bolting engaging the interior to the hull portion.

7. The boat in claim 3, further comprising a lightweight foam material filling the spaces defined between the hull and the interior of the boat.

* * * * *